US010544787B2

(12) United States Patent
Li et al.

(10) Patent No.: US 10,544,787 B2
(45) Date of Patent: Jan. 28, 2020

(54) PUMP DEVICE

(71) Applicant: Johnson Electric S.A., Murten (CH)

(72) Inventors: Min Li, Shenzhen (CN); Kok Ang Chong, Hong Kong (CN); Xiao Bo Xie, Shenzhen (CN); Shao Peng Mo, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 288 days.

(21) Appl. No.: 15/480,893

(22) Filed: Apr. 6, 2017

(65) Prior Publication Data

US 2017/0292521 A1 Oct. 12, 2017

(30) Foreign Application Priority Data

Apr. 6, 2016 (CN) ..... 2016 1 0211750

(51) Int. Cl.

| | |
|---|---|
| ***F04D 29/58*** | (2006.01) |
| ***F04D 1/02*** | (2006.01) |
| ***F04D 29/42*** | (2006.01) |
| ***F04D 29/22*** | (2006.01) |
| ***F04D 29/44*** | (2006.01) |
| ***F04D 29/70*** | (2006.01) |

(52) U.S. Cl.

CPC ..... *F04D 1/025* (2013.01); *F04D 29/22* (2013.01); *F04D 29/426* (2013.01); *F04D 29/445* (2013.01); *F04D 29/5806* (2013.01); *F04D 29/708* (2013.01)

(58) Field of Classification Search

CPC . F04D 1/00; F04D 17/08; F04D 17/10; F04D 29/708; F04D 29/5806; F04D 29/426; F04D 29/22; F04D 29/445; F04D 29/406; F04D 29/4293; F04D 29/70; F04D 29/701; F04D 29/4206; F04D 29/28; F05B 2260/63

See application file for complete search history.

(56) References Cited

U.S. PATENT DOCUMENTS 3,067,690 A * 12/1962 Kramer ..... F04D 13/0613 310/63
2004/0062664 A1 4/2004 Weigold et al.
2010/0272562 A1* 10/2010 Hammar ..... F04D 29/4273 415/204

(Continued)

*Primary Examiner* — Devon C Kramer
*Assistant Examiner* — David N Brandt
(74) *Attorney, Agent, or Firm* — Muncy, Geissler, Olds & Lowe, P.C.

(57) ABSTRACT

A pump device includes a casing, an impeller, a base, and a motor. The casing includes a pump chamber, and an inlet and an outlet. The impeller is accommodated in the pump chamber. The motor is connected to the casing for driving the impeller to rotate and includes a rotor chamber for receiving a rotor. The base is disposed between the impeller and the motor and includes an accommodating groove having an inlet port in communication with the rotor chamber to allow fluid in the pump chamber to enter into the rotor chamber. In the pump device, precipitation has been performed to fluid in the accommodating groove before the fluid enters into the rotor chamber, thus the impurity particles can be prevented from entering into the rotor chamber, thereby prolonging the service life of the pump device.

17 Claims, 8 Drawing Sheets

(56) References Cited

U.S. PATENT DOCUMENTS

2015/0337859 A1* 11/2015 Qi ..... F04D 1/00
415/177
2016/0281718 A1* 9/2016 Zhang ..... F04D 1/00

* cited by examiner

PUMP DEVICE

CROSS REFERENCE TO RELATED APPLICATIONS

This non-provisional patent application claims priority under 35 U.S.C. § 119(a) from Patent Application No. 201610211750.2 filed in The People's Republic of China on Apr. 6, 2016.

FIELD OF THE INVENTION

The present invention relates to a pump device.

BACKGROUND OF THE INVENTION

When a pump device is in operation, a rotor of the pump rotates in a fluid. The fluid can cool the rotor and can lubricate the rotor as well. However, there are usually impurity particles in the fluid, and if these impurity particles stay in a rotor chamber, they may easily cause damage to the rotor, or even lead to blockage, thereby shortening the service life of the pump device.

SUMMARY OF THE INVENTION

Thus, there is a desire for a pump device having extended service life.

A pump device is provided which may include a casing, an impeller, a base, and a motor for driving the impeller to rotate. The casing includes a pump chamber, and an inlet and an outlet in communication with the pump chamber. The impeller is accommodated in the pump chamber. The motor is connected to the casing and includes a rotor chamber for receiving a rotor. The base is disposed between the impeller and the motor. The base is provided with an accommodating groove and an inlet port defined in the accommodating groove in communication with the rotor chamber to allow fluid in the pump chamber to enter into the rotor chamber.

Preferably, a flange protrudes from one side of the base away from the motor, the flange surrounds the impeller, and the accommodating groove is defined in the flange.

Preferably, a cover part is formed on a sidewall of the pump chamber, the cover part covers the accommodating groove, the inlet port is defined in a sidewall of the accommodating groove adjacent the impeller, allowing the fluid to enter into the accommodating groove through the inlet port.

Preferably, the inlet port is defined in a top surface of the sidewall of the accommodating groove adjacent the impeller, and a gap is defined between a bottom side of the inlet port and the cover part.

Preferably, the gap has a size less than 1 mm, or less than or equal to 0.5 mm and greater than or equal to 0.3 mm, or less than or equal to 0.3 mm.

Preferably, the base includes a base body and a first fitting portion protruding from a side of the base body away from the impeller, the first fitting portion is accommodated in the rotor chamber, and a gap is defined between the first fitting portion and a sidewall of the rotor chamber, to allow the fluid to enter into the rotor chamber.

Preferably, a flow inlet is defined in an end of the sidewall of the rotor chamber adjacent the impeller, the gap is defined between the first fitting portion and a bottom portion of the flow inlet.

Preferably, a step is formed on the sidewall of the rotor chamber adjacent the first fitting portion and below the flow inlet, the first fitting portion includes a lateral side surface facing the sidewall of the rotor chamber, an end surface facing the step, and a connecting surface connected between the lateral side surface and the end surface, the gap comprises a first gap defined between the first fitting portion and the bottom portion of the flow inlet, and a second gap is defined between the end surface and the step.

Preferably, a bottom portion of the flow inlet is adjacent the lateral side surface of the first fitting portion and connected to the step, and the first gap is defined between the bottom portion of the flow inlet and the first fitting portion.

Preferably, the first gap between the bottom portion of the flow inlet and the first fitting portion has a minimum size less than 1 mm, or less than or equal to 0.5 mm and greater than or equal to 0.3 mm, or less than or equal to 0.3 mm.

Preferably, an annular groove is defined in the sidewall of the rotor chamber above the step, an annular protrusion is formed on the lateral side surface of the first fitting portion and engages in the groove, the flow inlet extends through the groove and communicates with the rotor chamber.

Preferably, the motor comprises a rotor housing, the rotor housing includes a base member and an accommodating portion provided at the base member, the base member is connected to the casing and a stator of the motor, the rotor chamber is defined by a hollow portion of the accommodating portion, the base member concaves around the rotor chamber to form a receiving groove, the flow inlet is in communication with the receiving groove.

Preferably, the base further includes a second fitting portion protruding from the base body, and the second fitting portion is disposed away from the impeller and is accommodated in the receiving groove and engages with a sidewall of the receiving groove away from the rotor chamber.

Preferably, the base further includes a plurality of stopping portions formed on the base body, each of the stopping portions is connected between the first fitting portion and the second fitting portion, the stopping portions are accommodated in the receiving groove such that cavities are defined between the stopping portions.

Preferably, the pump device further includes a heating assembly disposed in the casing for heating fluid.

A pump device is provided which may include a casing, an impeller, a motor and a base. The casing includes an inlet and an outlet. The impeller is accommodated in the casing. The motor includes a stator, a rotor housing connected to stator and the casing, and a rotor connected to the impeller. The rotor housing includes a rotor chamber for receiving the rotor. The base is disposed between the impeller and the rotor housing. The base defines an inlet port to allow fluid in the pump chamber to enter into the rotor housing, and a gap is defined in the rotor housing, or the base, or between the rotor housing and the base, to allow the fluid in the rotor housing to enter into the rotor chamber.

Preferably, the base is provided with an accommodating groove for receiving the fluid, and the inlet port is defined in a sidewall of the accommodating groove.

Preferably, the rotor housing defines a receiving groove around the rotor chamber for receiving the fluid, the base comprises a first fitting portion accommodated in the rotor chamber, and the gap is defined between the first fitting portion and the rotor chamber, for allowing the fluid in the receiving groove to enter into the rotor chamber.

Preferably, a sidewall of the rotor chamber defines a flow inlet in communication with the receiving groove, the gap is defined between the first fitting portion and a bottom portion of the flow inlet.

Preferably, the inlet port and the gap each has a size less than 1 mm, or less than or equal to 0.5 mm and greater than or equal to 0.3 mm, or less than or equal to 0.3 mm.

In the pump device provided in the present invention, precipitation has been performed to the fluid in the accommodating groove before the fluid enters into the rotor chamber. Therefore, the impurity particles can be prevented from entering into the rotor chamber, and hence the rotor and the like can be protected from being damaged, thereby prolonging the service life of the pump device.

DETAILED DESCRIPTION OF THE PREFERRED EMBODIMENTS

The technical solutions of the embodiments of the present disclosure will be clearly and completely described as follows with reference to the accompanying drawings. Apparently, the embodiments as described below are merely part of, rather than all, embodiments of the present invention. Based on the embodiments of the present disclosure, any other embodiment obtained by a person skilled in the art without paying any creative effort shall fall within the protection scope of the present invention.

It is noted that, when a component is described to be "connected" to another component, it can be directly connected to the another component or there may be an intermediate component. When a component is described to be "disposed" on another component, it can be directly disposed on the another component or there may be an intermediate component. The term "housing" or similar expressions are for the purposes of illustration only.

Unless otherwise specified, all technical and scientific terms have the ordinary meaning as commonly understood by people skilled in the art. The terms used in this disclosure are illustrative rather than limiting. The term "and/or" used in this disclosure means that each and every combination of one or more associated items listed are included.

Figure 1:
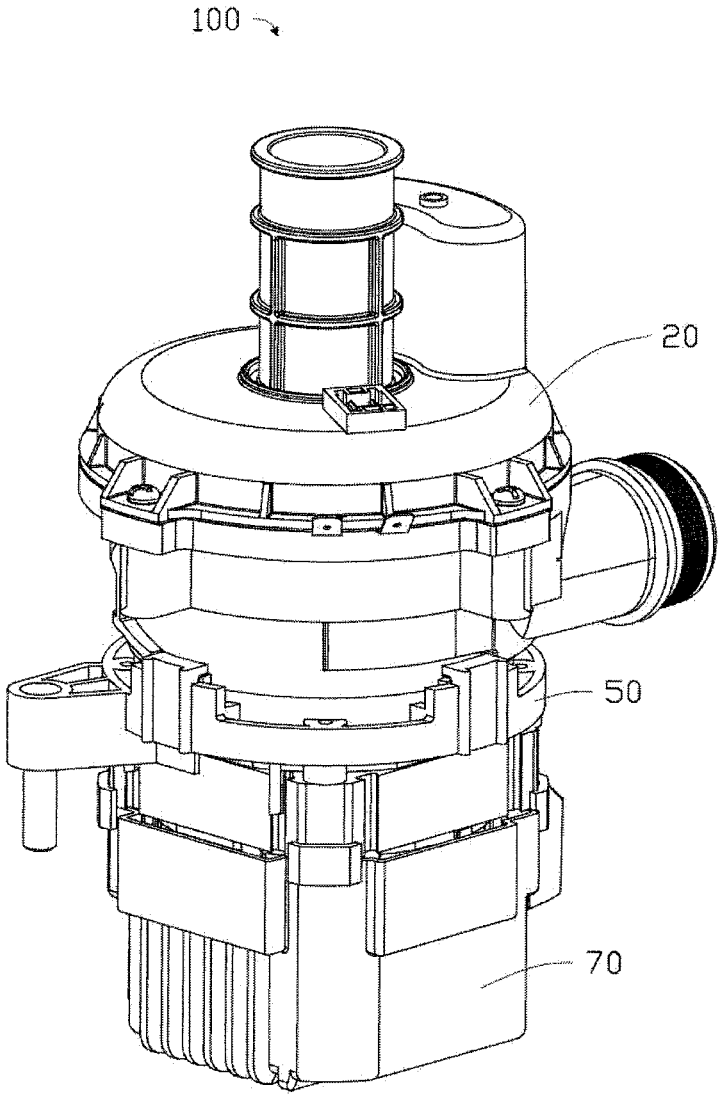
FIG. 1 is a perspective view of a pump device according to one embodiment of the present disclosure.

Referring to FIG. 1, one embodiment of the present disclosure provides a pump device 100, which is particularly suitable for pumping a liquid such as water and oil. In the present embodiment, the pump device 100 is used as a heating pump applied in a dishwasher (not shown). It should be understood that the pump device 100 may also be used to pump and/or discharge a fluid having fluidity such as gas.

Figure 2:
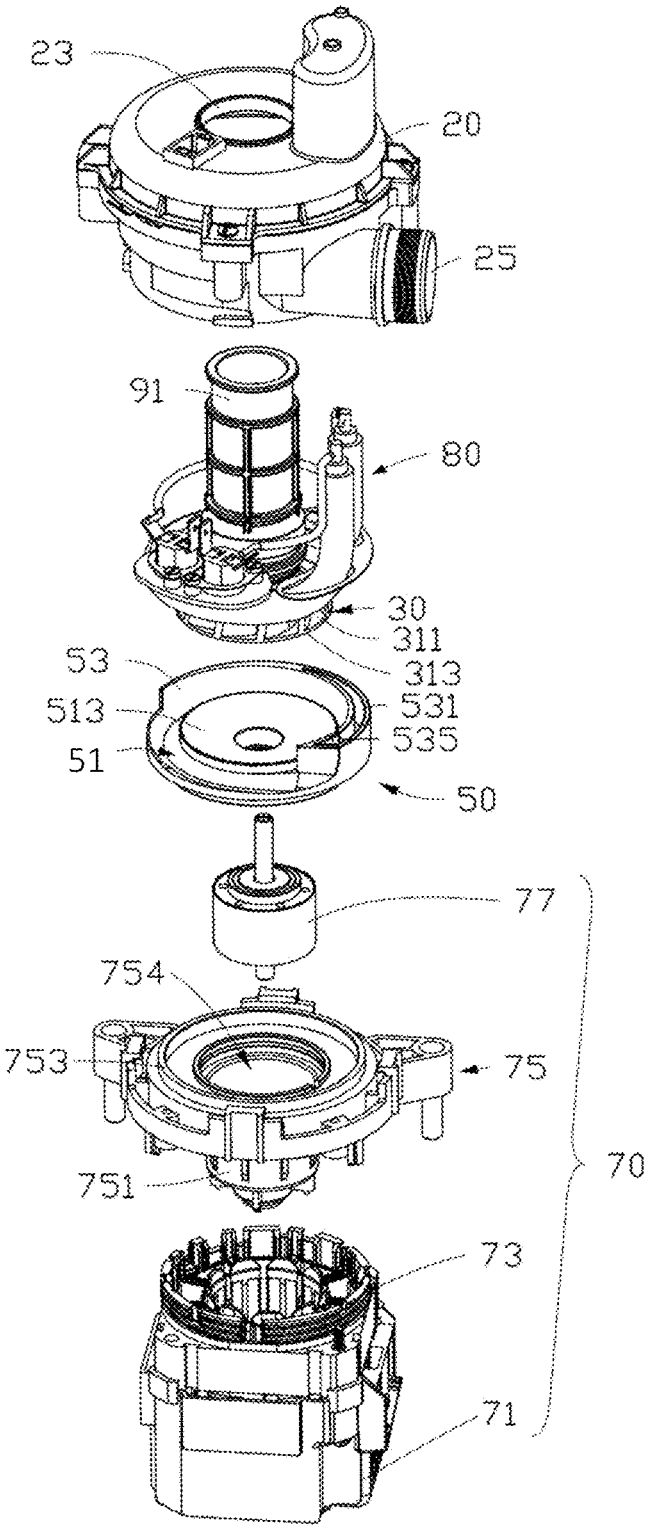
FIG. 2 is a perspective exploded view of the pump device shown in FIG. 1.
Figure 3:
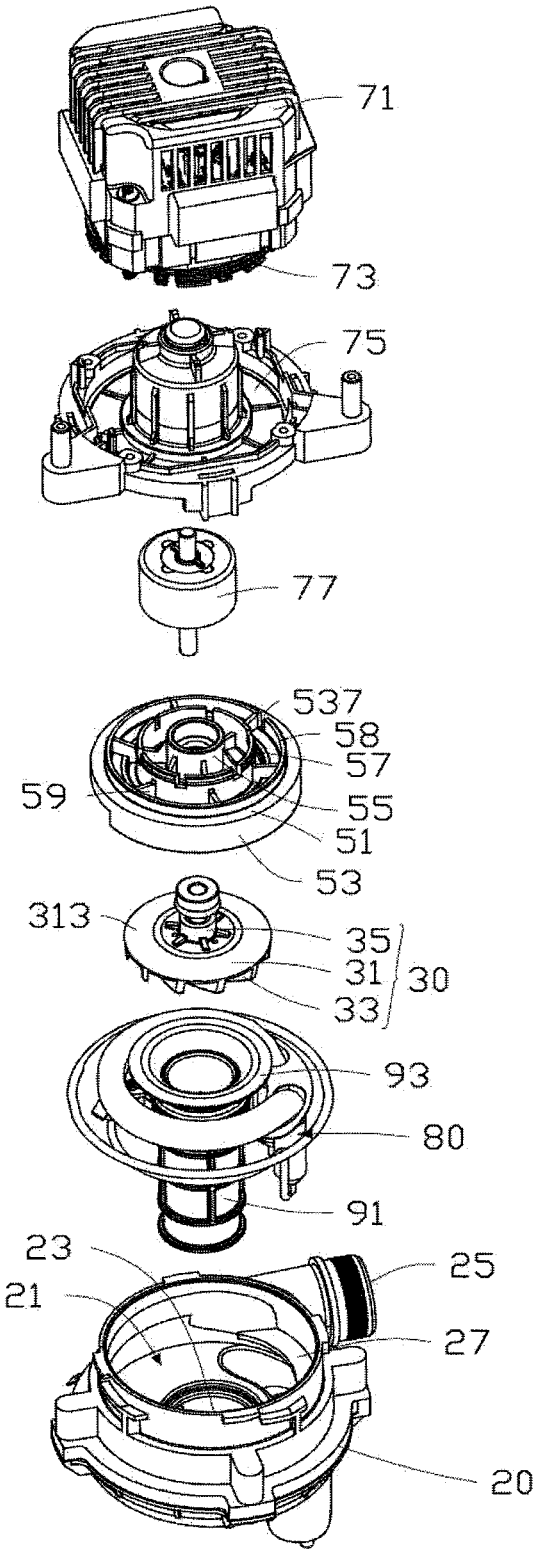
FIG. 3 is a perspective exploded view of the pump device shown in FIG. 1, viewed from another aspect.
Figure 4:
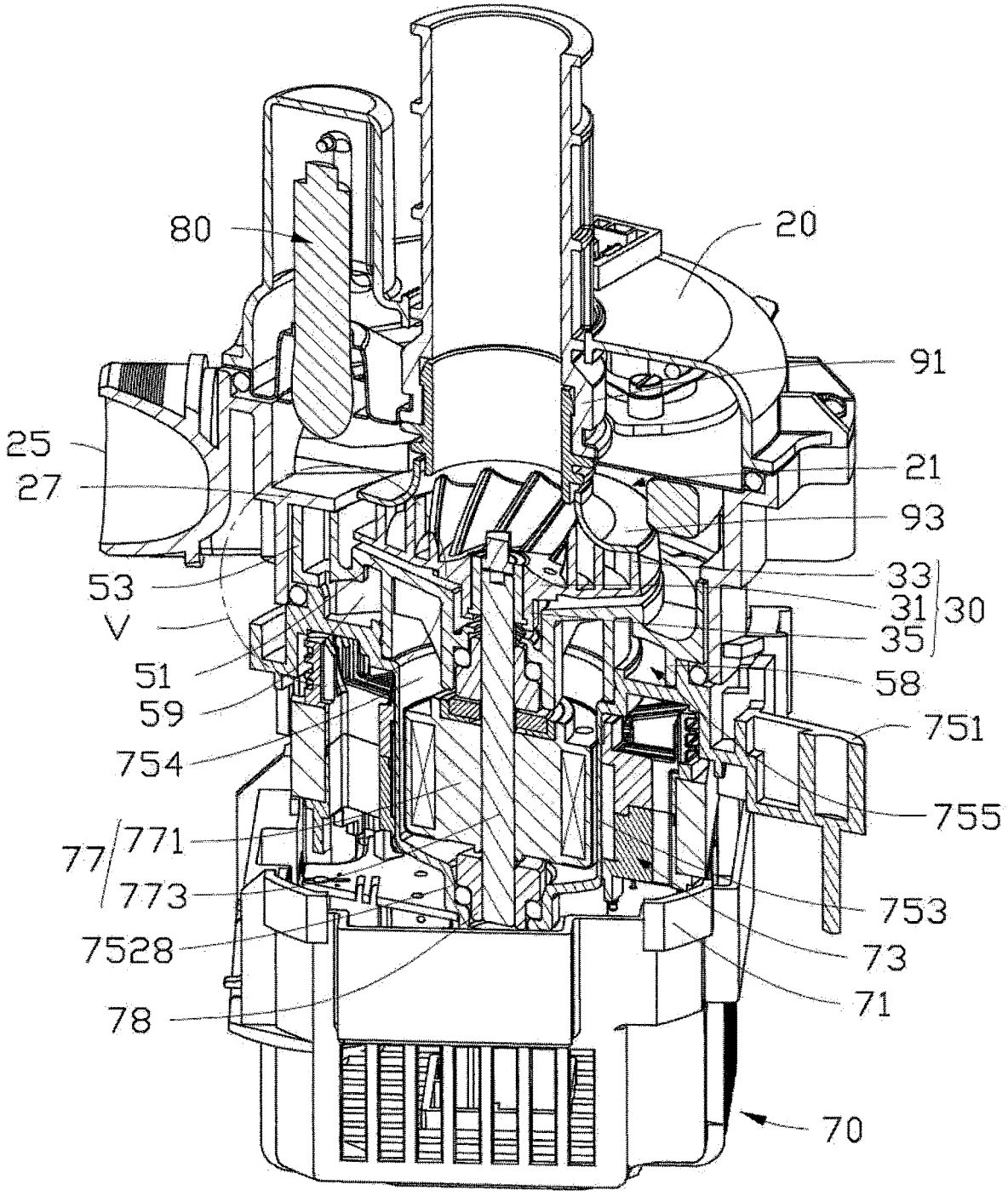
FIG. 4 is a partial, perspective sectional view of the pump device shown in FIG. 1.

Referring to FIG. 2 to FIG. 4, the pump device 100 includes a casing 20, an impeller 30, a base 50, a heating assembly 80, and a motor 70 for driving the impeller 30. The impeller 30 is accommodated in the casing 20 and is connected to the motor 70. The base 50 is disposed between the impeller 30 and the motor 70. The heating assembly 80 is disposed in the casing 20 for heating fluid.

In this embodiment, the casing 20 is of a volute shape, and includes a pump chamber 21, and an inlet 23 and an outlet 25 in communication with the pump chamber 21. In the present embodiment, the inlet 23 is disposed in a top wall of the pump chamber 21, and the outlet 25 is disposed in a lateral side of the pump chamber 21. A cover part 27 protrudes from an inner side surface of the pump chamber 21 adjacent the outlet 25.

The impeller 30 is accommodated in the pump chamber 21 adjacent the cover part 27, and includes a bottom plate 31, a plurality of vanes 33 and a connecting shaft 35. The bottom plate 31 includes a first installation surface 311 and an opposite second installation surface 313. The first installation surface 311 is oriented towards the inlet 23. The vanes 33 are disposed on the first installation surface 311 at intervals. The connecting shaft 35 protrudes from the second installation surface 313, for being non-rotatably connected with the motor 70.

Figure 5:
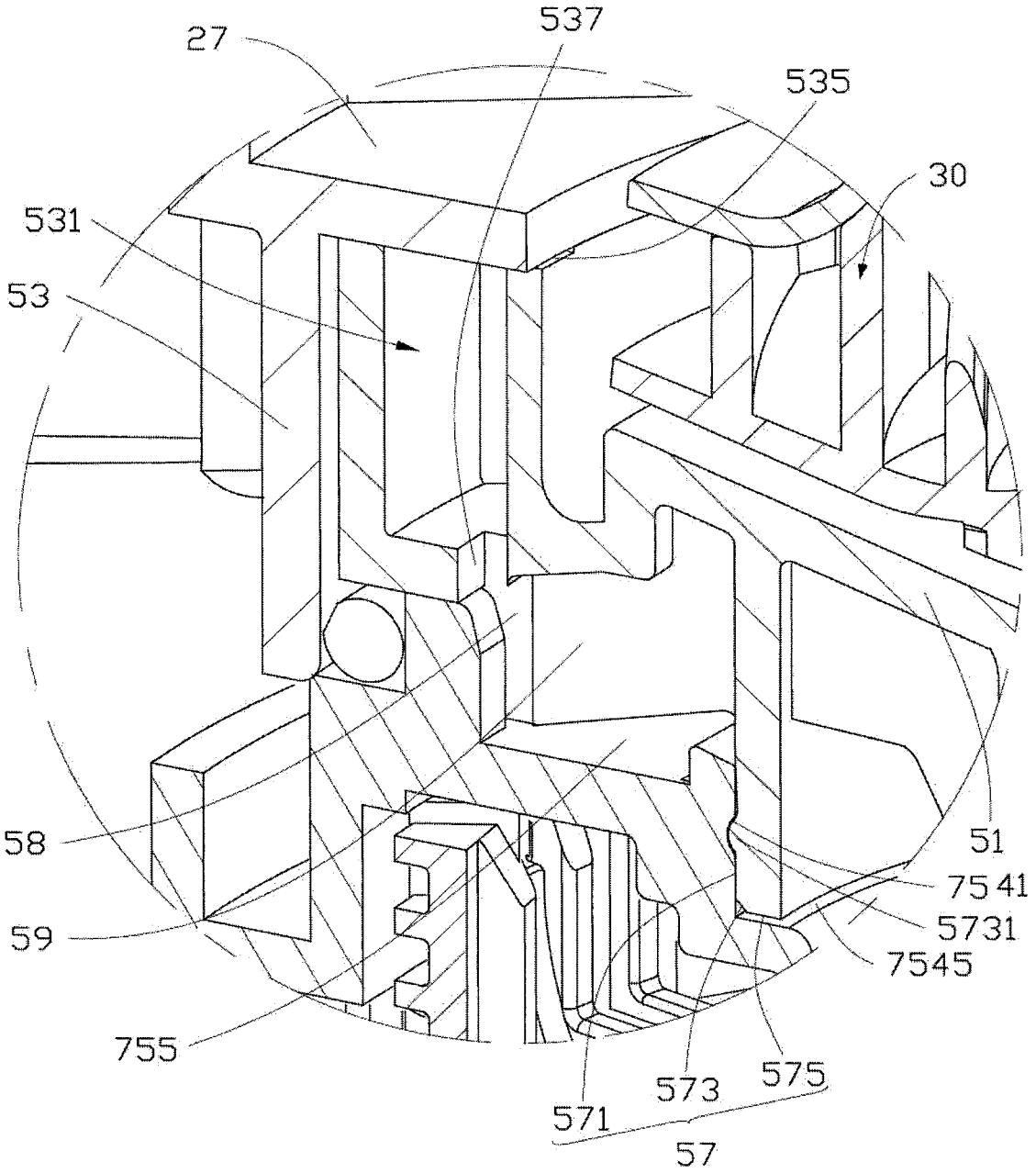
FIG. 5 is an enlarged view of a portion V of the pump device shown in FIG. 4.

The base 50 is accommodated in the pump chamber 21, and the impeller 30 is accommodated in the base 50. In the present embodiment, the base 50 includes a base body 51, a flange 53, a first bearing seat 55, a first fitting portion 57, a second fitting portion 58, and a plurality of stopping portions 59. The connecting shaft 35 extends through the base body 51. Referring to FIG. 2 again, a mating surface 513 is provided at one side of the base body 51 facing the impeller 30, and corresponds to the second installation surface 313. The flange 53 protrudes from a periphery of the one side of the base body 51 facing the impeller 30. The flange 53 defines an accommodating groove 531 for accommodating impurity particles in the fluid. The cover part 27 covers the flange 53. In the present embodiment, the second installation surface 313 is an inclined surface (as shown in FIG. 3), and the mating surface 513 is an inclined surface, so as to facilitate assembly. An inlet port 535 (as shown in FIG. 5) is defined in a sidewall of the accommodating groove 531 adjacent the mating surface 513, to allow the fluid in the pump chamber 21 to enter into the accommodating groove 531. In the present embodiment, the inlet port 535 is defined in a top surface of the sidewall of the accommodating groove 531 adjacent the cover part 27, and a gap is defined between a bottom side of the inlet port 535 and the cover part 27. The gap has a height less than 1 mm, preferably less than or equal to 0.5 mm and greater than or equal to 0.3 mm, so that the impurity particles with a size greater than 0.5 mm in the fluid cannot enter into the accommodating groove 531, thereby playing a role of filtering. It should be understood that, the inlet port 535 may not be defined in the top surface of the sidewall of the accommodating groove 531 adjacent the cover part 27, and the inlet port 535 may also be provided at another position of the sidewall. It should be understood that, the inlet port 535 and the gap may be sized according to actual needs. In other embodiments, the gap may have a height less than or equal to 0.3 mm.

Referring to FIG. 3, the first bearing seat 55 protrudes from one side of the base body 51 away from the impeller 30. The first fitting portion 57 and the second fitting portion 58 protrude from the base body 51 around the first bearing seat 55, and are spaced from each other. The first fitting portion 57 is located between the second fitting portion 58 and the first bearing seat 55. In the present embodiment, a through hole 537 extends through the second fitting portion 58 and communicates with the accommodating groove 531. It should be understood that, the through hole 537 may be located on the base body 51 between the first fitting portion 57 and the second fitting portion 58. Referring to FIG. 5 again, the first fitting portion 57 includes a lateral side surface 571, a connecting surface 573 and an end surface 575. The lateral side surface 571 is adjacent the base body 51 and is oriented towards the second fitting portion 58. The connecting surface 573 is connected between the lateral side surface 571 and the end surface 575. The end surface 575 is located at a distal end of the first fitting portion 57 away from the base body 51. A protrusion 5731 is formed on the lateral side surface 571 of the first fitting portion 57. The stopping portions 59 protrude from the base body 51 at intervals, and are located between the first fitting portion 57 and the second fitting portion 58, thereby forming cavities between the stopping portions 59.

Referring to FIG. 3 and FIG. 4, the motor 70 includes a motor housing 71, a stator 73, a rotor housing 75 and a rotor 77. The stator 73 is accommodated in the motor housing 71. The rotor housing 75 is accommodated in the stator 73. One end of the rotor housing 75 is fixedly connected to the stator 73, and the other end of the rotor housing 75 is fixedly connected to an end of the casing 20.

Figure 6:
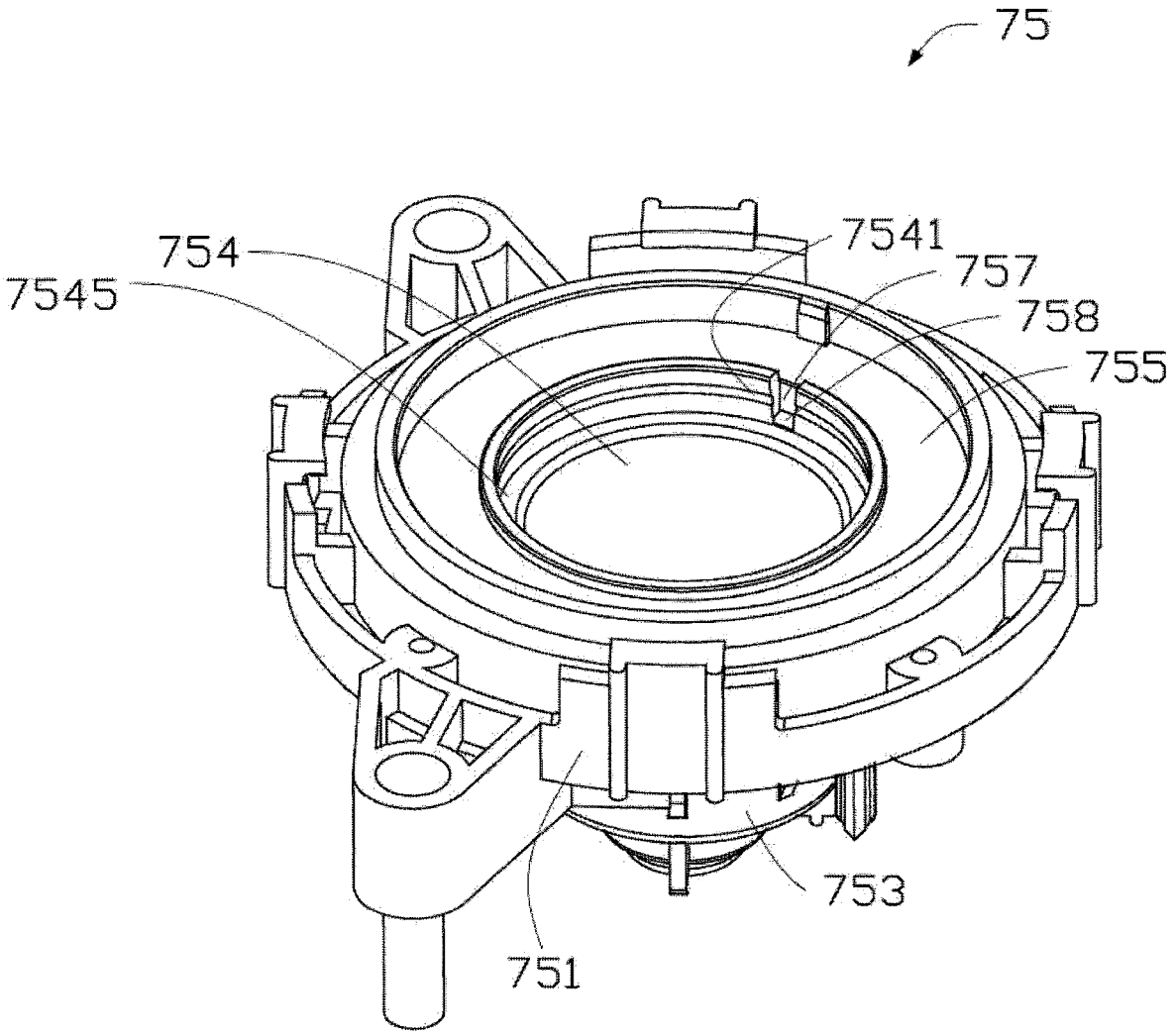
FIG. 6 is a perspective view of a rotor housing.

Referring also to FIG. 6, the rotor housing 75 includes a base member 751 and an accommodating portion 753 provided at the base member 751. The base member 751 is fixedly connected to the casing 20 and the stator 73. An approximately central portion of the base member 751 is concaved towards one side thereof away from the impeller 30 to thereby form the accommodating portion 753. The accommodating portion 753 is formed as a hollow cylinder with a hollow portion thereof defining a rotor chamber 754 for accommodating the rotor 77. An annular groove 7541 is defined in a sidewall of the rotor chamber 754. The groove 7541 engages with the protrusion 5731 of the base 50. A step 7545 is formed at the sidewall of the rotor chamber 754 below the groove 7541. A receiving groove 755 is defined in the base member 751 around the rotor chamber 754 by concaving the base member 751 around the rotor chamber 754. The second fitting portion 58 is accommodated in the receiving groove 755, and engages with a sidewall of the receiving groove 755 away from the rotor chamber 754. A flow inlet 757 is defined in a sidewall of the receiving groove 755 adjacent the rotor chamber 754, extends through the groove 7541 and is in communication with the rotor chamber 754, thereby allowing the fluid to flow from the receiving groove 755 into the rotor chamber 754 through the flow inlet 757. In other words, the flow inlet 757 is defined in the sidewall of the rotor chamber 754 and is in communication with the receiving groove 755. A bottom portion 758 of the flow inlet 757 is connected to the step 7545.

Figure 7:
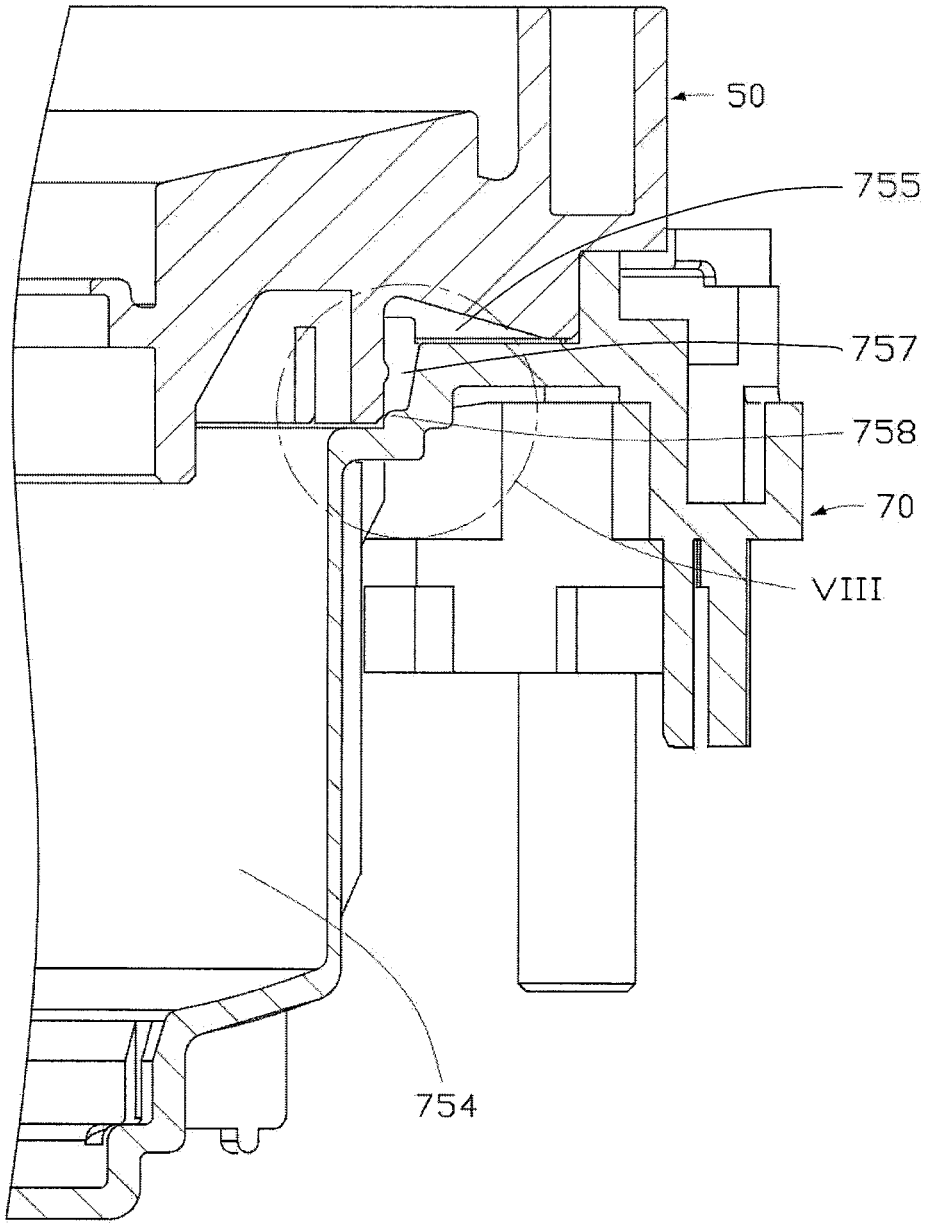
FIG. 7 is a partial sectional view of the rotor housing assembled with a base.
Figure 8:
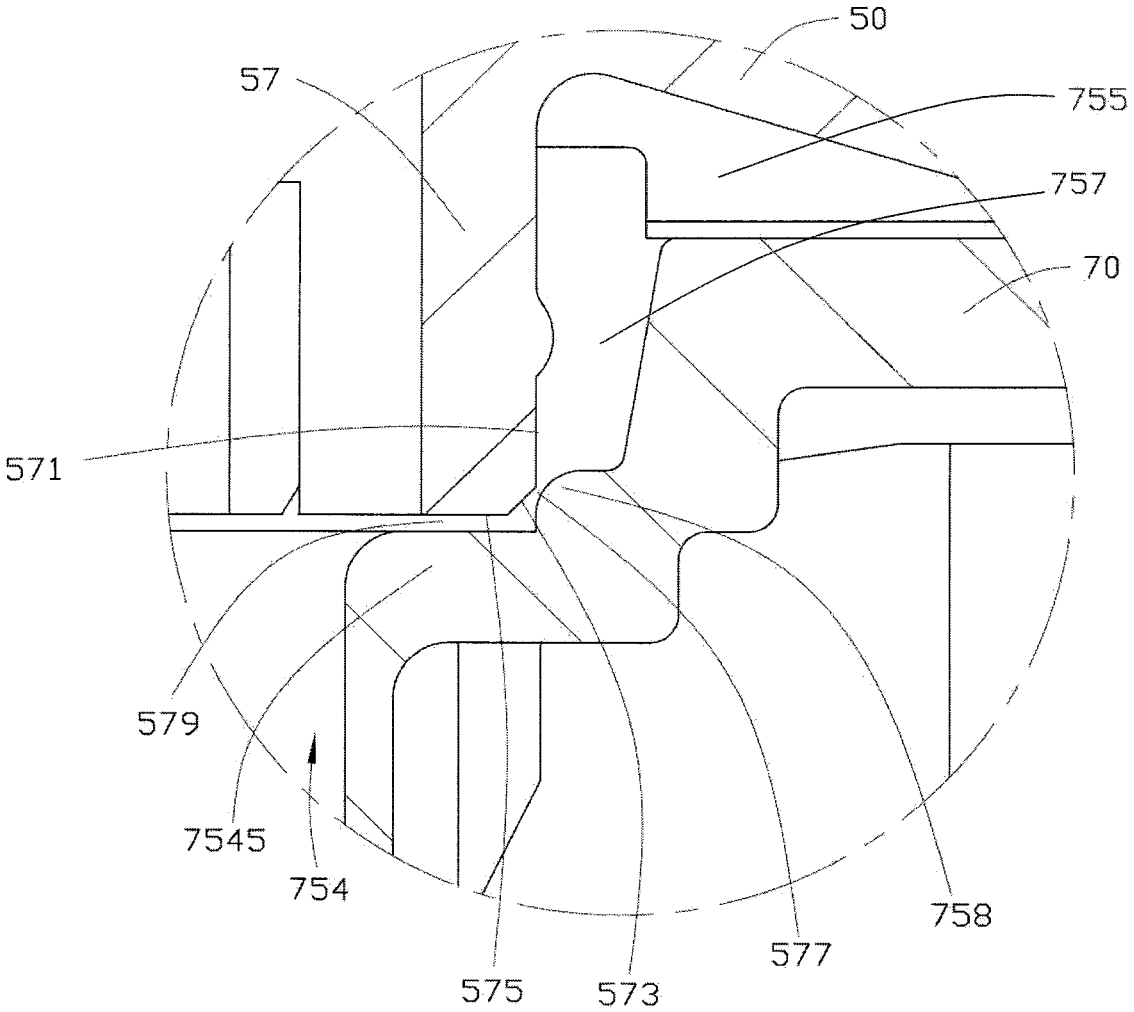
FIG. 8 is an enlarged view of a portion VIII shown in FIG. 7.

Referring to FIG. 7 and FIG. 8, a gap is defined between the first fitting portion 57 and the sidewall of the rotor chamber 754, to allow the fluid to enter into the rotor chamber 754 through the gap. Preferably, the gap includes a first gap 577 defined between the first fitting portion 57 and the bottom portion 758 of the flow inlet 757, and a second gap 579 defined between the end surface 575 and the step 7545. The first gap 577 is in communication with the second gap 579. The first gap 577 has a minimum size less than 1 mm, preferably less than or equal to 0.5 mm and greater than or equal to 0.3 mm, thereby further preventing the impurity particles with a size greater than 0.5 mm in the fluid from entering into the rotor chamber 754. It should be understood that, the minimum gap between the first fitting portion 57 and the sidewall of the rotor chamber 754 may be set to have a size less than or equal to 0.5 mm and greater than or equal to 0.3 mm. The gap between the first fitting portion 57 and the sidewall of the rotor chamber 754 is not limited to be disposed between the first fitting portion 57 and the bottom portion 758 of the flow inlet 757. Instead, the gap between the first fitting portion 57 and the sidewall of the rotor chamber 754 only needs to permit the fluid to enter into the rotor chamber 754. In other embodiments, the gap between the first fitting portion 57 and the sidewall of the rotor chamber 754 may have a size less than or equal to 0.3 mm. It should be understood that, the gap between the first fitting portion 57 and the sidewall of the rotor chamber 754 may be sized according to actual needs.

Referring to FIG. 4 again, the rotor 77 is rotatably accommodated in the rotor chamber 754, and includes a rotor body 771 and an output shaft 773. The output shaft 773 extends though the rotor body 771 and is connected to the rotor body 771. An end of the output shaft 773 extends out of the rotor chamber 754 to non-rotatably connect to the connecting shaft 35, thereby enabling the impeller 30 to be driven by the output shaft 773 to rotate.

Referring to FIG. 2 to FIG. 4, the heating assembly 80 is accommodated in the pump chamber 21 for heating the fluid. The pump device 100 further includes a pipe 91 for transferring the fluid to the pump chamber 21. The pipe 91 extends through the inlet 23 of the pump chamber 21 and is located above the impeller 30. The heating assembly 80 surrounds the pipe 91. The impeller 30 further includes a cover plate 93 which is accommodated in the pump chamber 21. The cover plate 93 is substantially trumpet-shaped, and has one end with a larger size contacting with the vanes 33 for guiding the fluid towards the vanes 33. The motor 70 further includes two bearings 78. A second bearing seat 7528 is formed at one end of the rotor chamber 754 away from the impeller 30. One of the two bearings 78 is installed and accommodated in the first bearing seat 55 of the base 50, and the other bearing 78 is installed and accommodated in the second bearing seat 7528. The output shaft 773 extends through the two bearings 78. Of course, the pump device 100 further includes other necessary or non-essential components and structures, such as seals, explanations of which are not repeated herein in order to reduce the length of this disclosure.

In assembly, the stator 73 is fixed to the motor housing 71, and one bearing 78 is installed and accommodated in the second bearing seat 7528. The rotor 77 is placed in the rotor chamber 754. The rotor housing 75 together with the rotor 77 is placed in the stator 73. One end of the rotor housing 75 is fixedly connected to the motor housing 71, and the other bearing 78 is installed and accommodated in the first bearing seat 55. The impeller 30 is accommodated in the base 50. One end of the output shaft 773, which extends out of the rotor housing 75, is extended through the first bearing seat 55 of the base 50 and is non-rotatably connected to the impeller 30. The heating assembly 80 and the pipe 91 are received in the pump chamber 21, with one end of the pipe 91 away from the impeller 30 extending out of the inlet 23. The casing 20 is placed to cover on the base 50 and the impeller 30, and the casing 20 is fixedly connected to the motor 70.

In use, the rotor 77 of the motor 70 rotates relative to the stator 73, and the output shaft 773 drives the impeller 30 to rotate. The fluid enters into the pump chamber 21 through the pipe 91 and the impeller 30. The fluid is heated by the heating assembly 80, and most of the fluid is exhausted out of the pump device 100 through the outlet 25. Another part of the fluid enters into the accommodating groove 531 through the inlet port 535, then enters into the receiving groove 755 through the through hole 537, and then enters into the rotor chamber 754 through the flow inlet 757, the first gap 577 and the second gap 579, thereby achieving the functions of cooling and lubricating.

In the pump device 100 provided in the present disclosure, the fluid flows through the inlet port 535 and the first gap 577, each of which has a limited size, and the fluid may stay in the accommodating groove 531 and the receiving groove 755. Therefore, multi-stage filtration and precipitation has been performed to the fluid before the fluid enters into the rotor chamber 754, thereby preventing the impurity particles from entering into the rotor chamber 754 to damage the rotor 77, the bearings 78 and the like, and hence prolonging the service life of the pump device 100 and reducing the noise of the pump device 100. Further, due to the presence of the accommodating groove 531 and the cavities formed between the stopping portions 59 of the base 50, the fluid can stay in the accommodating groove 531 and one of the cavities communicating with the through hole 537 and the flow inlet 757 before entering into the rotor chamber 754, thereby allowing the fluid to stay in the accommodating groove 531 and the receiving groove 755 for precipitation and hence further reducing the impurity particles which enter into the rotor chamber 754.

It should be understood that, the heating assembly 80 may be omitted from the pump device 100, i.e., the pump device 100 does not have the heating function. The pump device 100 is not limited to be used in the dishwasher and, instead, it may be used in other equipment.

It should be understood that, in other embodiments, the accommodating groove 531 in the base 50 may be formed in the base body 51 by concaving the base body 51, and the fluid may flow into the rotor chamber 754 through the through hole 537.

In the embodiment, the first gap 577 is defined between the connecting surface 573 and the corner of the bottom portion 758, the connecting surface 573 is slanted, and a corner of the bottom portion 758 of the flow inlet 757 facing the connecting surface 573 is arcuate. It should be understood that, in other embodiments, the first gap may be directly formed between the lateral side surface 571 and the sidewall of the rotor chamber 754, and in further other embodiments, at least one of the connecting surface 573 and a corner of the bottom portion 758 of the flow inlet 757 facing the connecting surface 573 is slanted or arcuate.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated herein should not be interpreted as limits to the present invention, and the scope of the invention is to be determined by reference to the claims that follow.

The invention claimed is:

1. A pump device comprising:

a casing comprising a pump chamber, and an inlet and an outlet in communication with the pump chamber;

an impeller accommodated in the pump chamber;

a motor connected to the casing for driving the impeller to rotate and comprising a rotor chamber for receiving a rotor; and a base disposed between the impeller and the motor, wherein the base is provided with an accommodating groove, and an inlet port is defined in the accommodating groove in communication with the rotor chamber to allow fluid in the pump chamber to enter into the rotor chamber, wherein the base comprises a base body and a first fitting portion protruding from a side of the base body away from the impeller, the first fitting portion is accommodated in the rotor chamber, and a gap is defined between the first fitting portion and a sidewall of the rotor chamber, to allow the fluid to enter into the rotor chamber, a flow inlet is defined in an end of the sidewall of the rotor chamber adjacent the impeller, the gap is defined between the first fitting portion and a bottom portion of the flow inlet, a step is formed on the sidewall of the rotor chamber adjacent the first fitting portion and below the flow inlet, the first fitting portion comprises a lateral side surface facing the sidewall of the rotor chamber, an end surface facing the step, and a connecting surface connected between the lateral side surface and the end surface, the gap comprises a first gap defined between the first fitting portion and the bottom portion of the flow inlet, and a second gap defined between the end surface and the step.

2. The pump device of claim 1, wherein at least one of the connecting surface and a corner of the bottom portion of the flow inlet facing the connecting surface is slanted or arcuate.

3. The pump device of claim 2, wherein the first gap between the bottom portion of the flow inlet and the first fitting portion has a minimum size less than 1 mm, or less than or equal to 0.5 mm and greater than or equal to 0.3 mm, or less than or equal to 0.3 mm.

4. The pump device of claim 1, wherein an annular groove is defined in the sidewall of the rotor chamber above the step, an annular protrusion is formed on the lateral side surface of the first fitting portion and engages in the annular groove, the flow inlet extends through the annular groove and communicates with the rotor chamber.

5. The pump device of claim 1, wherein the motor comprises a rotor housing, the rotor housing comprises a base member and an accommodating portion provided at the base member, the base member is connected to the casing and a stator of the motor, the rotor chamber is defined in the accommodating portion, the base member concaves around the rotor chamber to form a receiving groove, the flow inlet is in communication with the receiving groove.

6. The pump device of claim 5, wherein the base further comprises a second fitting portion protruding from the base body, and the second fitting portion is disposed away from the impeller and is accommodated in the receiving groove and engages with a sidewall of the receiving groove away from the rotor chamber.

7. The pump device of claim 6, wherein the base further comprises a plurality of stopping portions formed on the base body, each of the stopping portions is connected between the first fitting portion and the second fitting portion, the stopping portions are accommodated in the receiving groove such that cavities are defined between the stopping portions.

8. A pump device comprising:

a casing comprising an inlet and an outlet;

an impeller accommodated in the casing;

a motor comprising a stator, a rotor housing connected to the stator and the casing, and a rotor connected to the impeller, the rotor housing comprising a rotor chamber for receiving the rotor; and a base disposed between the impeller and the rotor housing, wherein the base defines an inlet port to allow fluid in the casing to enter into the rotor housing, and a gap is defined between the rotor housing and the base, to allow the fluid in the rotor housing to enter into the rotor chamber, wherein the base comprises a base body and a first fitting portion protruding from a side of the base body away from the impeller, the first fitting portion is accommodated in the rotor chamber, a flow inlet is defined in an end of a sidewall of the rotor chamber adjacent the impeller, a step is formed on the sidewall of the rotor chamber adjacent the first fitting portion and below the flow inlet, the first fitting portion comprises a lateral side surface facing the sidewall of the rotor chamber and an end surface facing the step, the gap comprises a first gap defined between the first fitting portion and the bottom portion of the flow inlet, and a second gap defined between the end surface and the step.

9. The pump device of claim 8, wherein the rotor housing defines a receiving groove around the rotor chamber for receiving the fluid, the base comprises a first fitting portion accommodated in the rotor chamber, and the gap is defined between the first fitting portion and the rotor chamber, for allowing the fluid in the receiving groove to enter into the rotor chamber.

10. The pump device of claim 9, wherein a sidewall of the rotor chamber defines a flow inlet in communication with the receiving groove, the gap is defined between the first fitting portion and a bottom portion of the flow inlet.

11. The pump device of claim 8, wherein the inlet port and the gap each has a size less than 1 mm, or less than or equal to 0.5 mm and greater than or equal to 0.3 mm, or less than or equal to 0.3 mm.

12. The pump device of claim 1, wherein a flange protrudes from one side of the base away from the motor, the flange surrounds the impeller, and the accommodating groove is defined in the flange.

13. The pump device of claim 12, wherein a cover part is formed on the sidewall of the pump chamber, the cover part covers the accommodating groove, the inlet port is defined in a sidewall of the accommodating groove adjacent the impeller, allowing the fluid to enter into the accommodating groove through the inlet port.

14. The pump device of claim 13, wherein the inlet port is defined in a top surface of the sidewall of the accommodating groove adjacent the impeller.

15. The pump device of claim 14, wherein a gap between a bottom side of the inlet port and the cover part has a size less than 1 mm, or less than or equal to 0.5 mm and greater than or equal to 0.3 mm, or less than or equal to 0.3 mm.

16. The pump device of claim 1, further comprising a heating assembly disposed in the casing for heating fluid.

17. The pump device of claim 8, wherein the base is provided with an accommodating groove for receiving the fluid, and the inlet port is defined in a sidewall of the accommodating groove.

* * * * *